United States Patent [19]

Proehl

[11] Patent Number: 4,470,209

[45] Date of Patent: Sep. 11, 1984

[54] DREDGE SWINGING APPARATUS

[76] Inventor: Norman P. Proehl, 373 Westminster Ave., Lake Forest, Ill. 60045

[21] Appl. No.: 505,883

[22] Filed: Jun. 20, 1983

[51] Int. Cl.[3] ..... E02F 9/04; E02F 3/88

[52] U.S. Cl. ..... 37/73; 37/67

[58] Field of Search ..... 37/73, 67

[56] References Cited

U.S. PATENT DOCUMENTS

| | | | |
|---|---|---|---|
| 484,763 | 10/1892 | Bowers | 37/73 X |
| 515,379 | 2/1894 | Titcomb | 37/73 |
| 1,792,065 | 2/1931 | Bowers | 37/73 X |
| 2,061,440 | 11/1936 | Schaefer | 37/73 |
| 2,109,730 | 3/1938 | Le Tourneau | 37/73 |
| 2,850,814 | 9/1958 | Ellicott, Jr. | 37/73 |
| 3,218,739 | 11/1965 | Kaufmann et al. | 37/73 X |
| 3,656,449 | 4/1972 | Mead | 37/73 X |
| 3,902,448 | 9/1975 | Davis | 37/73 X |
| 3,919,791 | 11/1975 | Smith | 37/73 X |
| 4,026,049 | 5/1977 | Johnson | 37/67 |

FOREIGN PATENT DOCUMENTS

| | | | |
|---|---|---|---|
| 6803487 | 9/1969 | Netherlands | 37/73 |
| 176792 | 5/1923 | United Kingdom | 37/73 |
| 574506 | 10/1977 | U.S.S.R. | 37/73 |
| 708022 | 1/1980 | U.S.S.R. | 37/73 |

*Primary Examiner*—Clifford D. Crowder

*Attorney, Agent, or Firm*—Kinzer, Plyer, Dorn & McEachran

[57] ABSTRACT

A dredging apparatus including a spud barge and a dredging barge. A hollow pivot sleeve is located at the stern of the dredging barge. A hydraulically extendable arm is mounted on the spud barge and is pivotally connected to the pivot sleeve. A large diameter bull ring is affixed to the pivot sleeve. A pair of cables connect to the bull ring and to a pair of power driven winches on the spud barge. The winding and unwinding of the cables around their winches swings the dredging barge about the pivot sleeve during dredging. An anchor spud extends through the hollow pivot sleeve to hold the dredging barge in fixed position when the spud barge is being relocated.

4 Claims, 5 Drawing Figures

Fig. 1.
(PRIOR ART)
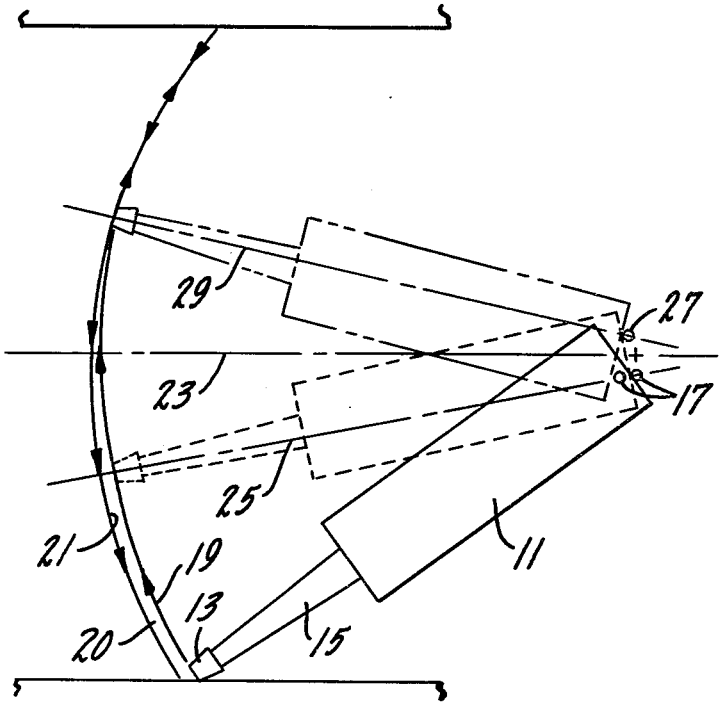
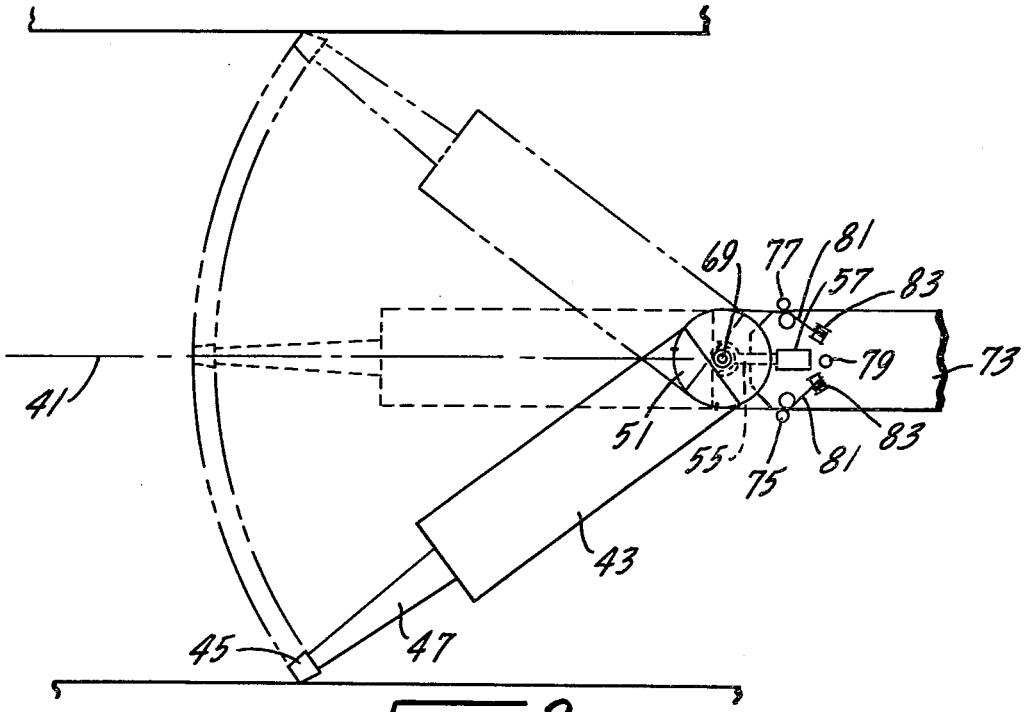
Fig. 2.

DREDGE SWINGING APPARATUS

BACKGROUND OF THE INVENTION

This invention is directed to an apparatus for continuous hydraulic dredging. Customarily, a hydraulic dredge is swung from side-to-side in an arc during dredging operations and after digging through an arc, or through several arcs if the depth of the digging is greater than that removed by the cut of a single arc, the hydraulic dredge is moved forward using a digging spud and a walking spud which are located on opposite sides of the dredge stern. The movement from side-to-side during digging has been controlled by swing cables attached to swing anchors with the cables wound and unwound on winch drums. If the dredging is done in open water, the swing anchors are carried by boats to their positions and dropped into the water. If the dredging in done in a narrow channel, the swing anchors are located on land on opposite sides of the channel area being dredged.

In open water, the present method of moving the swing anchors requires the use of one or more anchor barges. When the dredge has completed digging in its arc, the anchor barge lifts one anchor and moves it forward the required distance which can possibly be 60, 70 or 80 feet. It then drops the anchor to the bottom of the cut. While this movement of the anchor is going on, the dredge has lowered its cutting ladder to the cut bottom so that it will hold itself in position while the setting of the anchor is tested. If the anchor which has been moved sets properly, then the anchor on the other side of the dredge must be moved to keep both anchors abreast of the dredge. If shore or land anchors are used, these must also be moved in the same manner. Under best dredging conditions, about 12% of available dredge time is spent in moving anchors. Under poor conditions, as much as 25% of the available dredge time can be spent relocating the anchors.

Another obstacle to continuous dredging is the necessity to move the dredge forward along its cutting path. With present types of dredges which use a walking spud and a digging spud, considerable time is wasted in lowering and lifting the walking and digging spuds when it is necessary to move the dredge to a new digging position.

Thus, an object of this invention is an apparatus for more efficiently conducting shallow dredging where the cutter head is moved through only a single cutting arc to reach its maximum digging depth.

Another object of this invention is an apparatus for advancing a hydraulic dredge without wasting any digging movements of the cutter head.

Another object of this invention is a dredging apparatus that does not require swing anchors.

Another object of this invention is a dredging apparatus that can dig efficiently in confined quarters.

Additional objects may be found in the following specification, claims and drawings.

BRIEF DESCRIPTION OF THE DRAWINGS

FIG. 1 is a schematic showing of a prior art hydraulic dredge which is advanced by stepping it about a walking spud with several alternate positions of the hydraulic dredge shown in dashed and phantom lines;

FIG. 2 is a schematic view of apparatus of this invention for advancing a hydraulic dredge barge with several alternate positions of rotation of the hydraulic dredge barge shown in dashed and phantom lines;

DESCRIPTION OF THE PREFERRED EMBODIMENT

Figure 3:
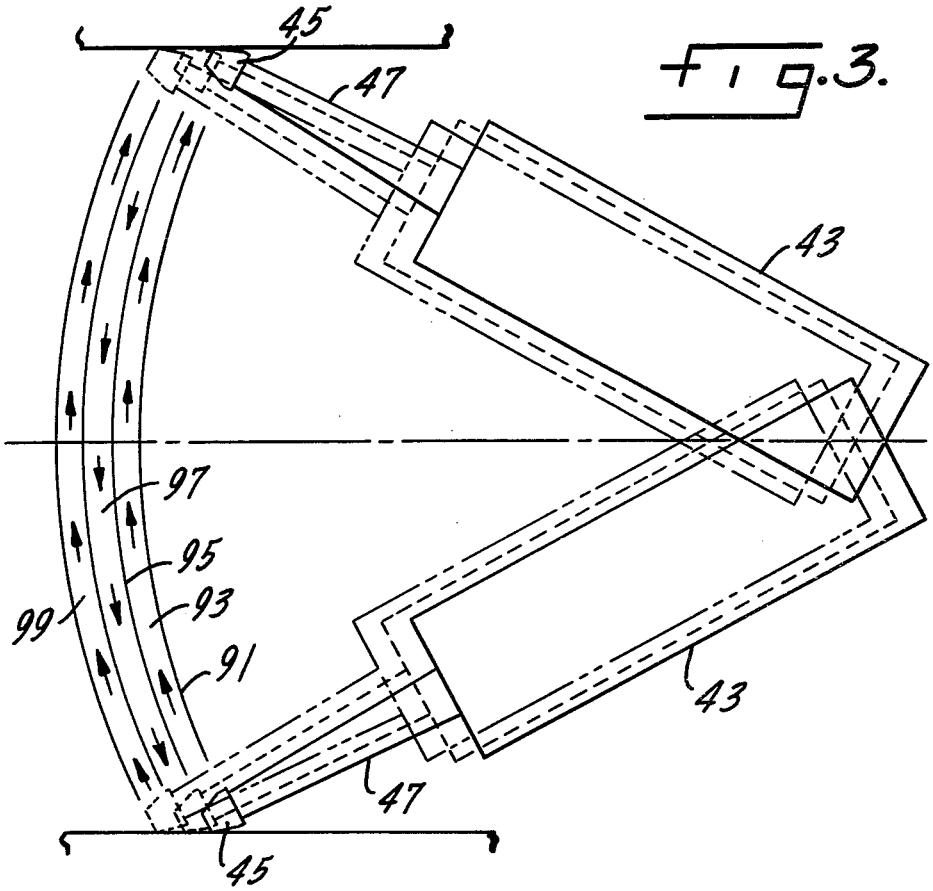
FIG. 3 is a schematic depiction of the dredge barge of this invention being advanced during cutting with the dredge barge shown at opposite sides of its swath and shown in its advanced positions in dashed and phantom lines.
Figure 4:
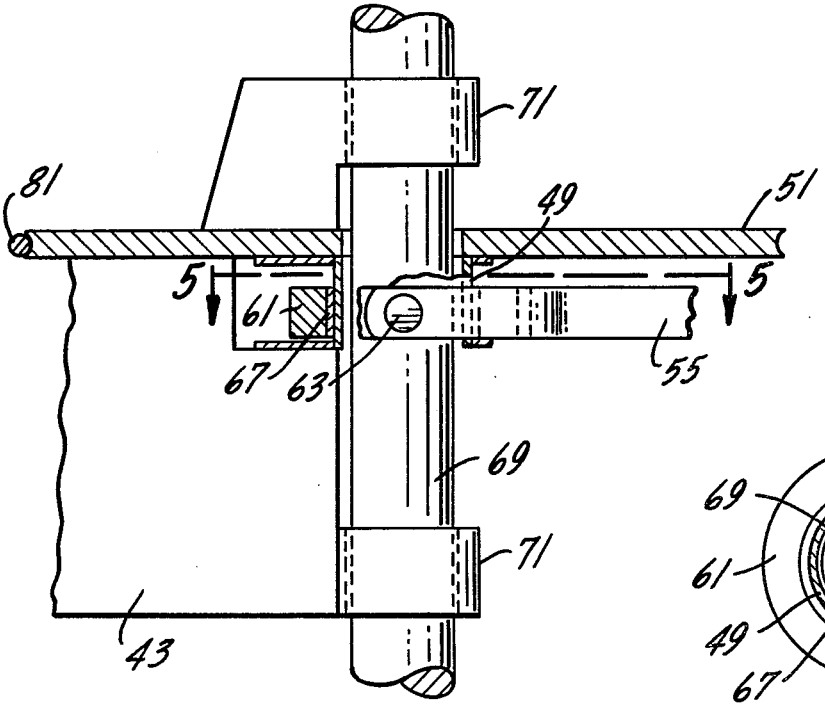
FIG. 4 is a enlarged partial side elevational view showing the pivotal mechanism for the dredge barge.
Figure 5:
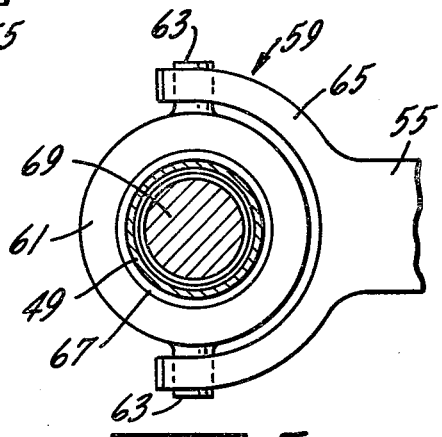
FIG. 5 is a cross sectional view taken along line 5—5 of FIG. 4.

FIG. 1 of the drawings shows the prior art method of advancing a hydraulic dredge 11 after the completion of digging along an arcuate swath to a desired depth. In the example shown, the width of the dredging path or channel being dug is approximately 250 feet although it should be understood that it could be much wider or narrower. At the completion of a cutting arc, the hydraulic dredge 11 is at the left-hand side of the path as viewed in the drawings. The dredge has completed its cutting swath using its cutter head 13 which is mounted on a ladder 15 by pivoting about its digging spud 17 which is positioned material which is being removed is indicated at 19. The distance the cutter head is to be advanced into the bank which is the width of the swath 20 is 6 feet and the position of the bank after the swath is dug is indicated at 21. To advance the cutter head the width of the swath 20, it is necessary to advance the digging spud 17 a distance of six feet along the center line 23 of the dredging path. In order to move the digging spud 17 through the bank of material, it is necessary to swing the cutter head 13 and dredge 11 toward the center line 23 of the dredging pathabout its digging spud 17 while the cutter head is digging.

When the cutter head has been swung approximately 23½° from the left side of the path to line 25 where the dredge is shown in dashed lines in the drawings, the walking spud 27 is lowered and embedded in the bottom of the channel in the position shown in FIG. 1. This new position is approximately 3 feet ahead of the original position of the digging spud 17. During the movement of the hydraulic dredge and cutter head from the far left position to the position of line 25 where the walking spud 27 is lowered and embedded, the cutter head has accomplished no dredging because it has not advanced into the bank 19. After the walking spud 27 is lowered and the digging spud 17 is raised, the hydraulic dredge 11 and its cutter head 13 are again rotated in a clockwise direction as shown in FIG. 1 past the center line 23 to line 29 where the dredge is shown in phantom line. This movement will position the hydraulic dredge and cutter head a clockwise distance of approximately 26½° beyond the position of line 25. During this pivotal swing about the walking spud 27, the cutter head is digging at least partially into the bank 19 towards the new bank line. The digging spud 17 has now been advanced a forward distance of 6 feet from its original position and the digging spud 17 is lower and the walking spud 27 is raised. The cutter head will now be able to dig through the swath 20 all the way to the new bank 21.

The hydraulic dredge and its cutter head are again rotated in a clockwise direction as shown in FIG. 1 about the new position of digging spud 17 until the cutter head 13 reaches the end of its cutting arc, which is approximately another 26½° beyond line 29. During this swing, the cutter head has removed the bank 19 through its full six foot swath 20. If the depth of the cut is such that the swath 20 has been dredged to its full depth, the counterclockwise rotation of the hydraulic dredge and its cutter head from the righthand side to the center line of the dredging path will be essentially wasted motion because no material will be removed from the bank during the first26½° of movement (to line 29) and only approximately half of the swath 20 will be removed during the next26½° of movement (to line 25). It will not be until the cutter head reaches line 25 that it will cut the full swath 20 of material. Thus, if only a single swing of the cutter head is necessary to remove the entire depth of the material being dredged, each side to side swing of the hydraulic dredge is only 50% efficient. The efficiency of such a dredge will increase if a number of swings are necessary to reach the full dredging depth before it is necessary to move the dredge forward into the bank. However, in any type of dredging where the dredge is stepped forward in the manner shown, there will be swings of the hydraulic dredge and cutter head where no digging takes place.

The apparatus of my invention is shown in FIGS. 2, 3, 4 and 5 of the drawings. In FIG. 2, the width of the dredge path, by way of example, is also 250 feet taken along center line 41. Hydraulic dredge barge 43 is equipped with a cutter head 45 mounted on a ladder 47 which is located at the forward end of the dredge. In my invention, the dredge barge 43 is equipped with a pivot sleeve 49 which is located on the center line of the dredge barge at the stern thereof and is fastened to the dredge barge. A large diameter bull ring 51 is also fastened to the hydraulic dredge barge and to the pivot sleeve concentrically therewith. A rod 55 which extends from a hydraulic cylinder 57 is pivotally connected to the pivot sleeve 49 by a universal type connection 59 consisting of a yoke 61 which receives the pivot sleeve 49. The yoke has diametrically projecting trunnions 63 which are journalled in openings (not shown) in a clevis 65 formed at the end of the rod 55. A bronze bearing 67 is located between the yoke 61 and the pivot sleeve 49 in the manner shown in FIGS. 4 and 5 of the drawings. An anchor spud 69 is supported on the hydraulic dredge barge 43 by upper and lower spud keepers 71 which permit it to move freely vertically through the pivot sleeve 49. The anchor spud may be raised and lowered relative to the pivot sleeve 49 in any conventional manner.

The hydralic cylinder 57 is mounted on a spud barge 73 which is positioned rearwardly of the stern of the hydraulic dredge barge 43. It should be understood and appreciated that the hydraulic cylinder 57 and rod 55 may be replaced by a rack and pinnion mechanism or the mechanical equivalent thereof which would also be mounted on the spud barge 73. The spud barge may be equipped with digging spuds such as spuds 75, 77, and 79 with one located on its port side and one on its starboard side and one on its center line just aft of the hydraulic cylinder 57. Of course it should be understood that other arrangements of the digging spuds may be provided.

The bull ring 51 is manipulated by means of cables 81 each of which is fastened at one end to the peripheral edge of the bull ring and has its other end wound around a power driven winch 83 mounted on the spud barge 73. The cables wind around sheaves 85 positioned on the barge for control of direction. A block and tackle (not shown) may be provided between each sheave and its winch to increase the mechanical advantage of the winches.

During dredging operations, the digging spuds 75, 77 and 79 are embedded in the bottom of the channel to hold the spud barge 73 in its proper position. The dredge barge 43 and its cutter head 45 are moved through digging arcs by winding and unwinding of the cables 81 around their power driven winches 83. The center of rotation of the dredge barge 43 during the cutting swings is about its pivot sleeve 49. When a cutting swath is completed, the dredge barge 43 is moved forward a distance equal to the depth of the new cut or swath by actuation of the hydraulic cylinder 57 which extends its rod 55 and thereby pushes the pivot sleeve 49 and the dredge barge 43, which is attached to it, away from the spud barge 73. When the rod 55 is fully extended relative to its hydraulic cylinder 57, it will then be necessary to relocate the spud barge 73 at the end of the final cutting swath. This is accomplished by dropping the anchor spud 69 when the cutter head reaches the end of its digging swing and embedding the anchor spud in the bottom of the channel. The digging spuds 75, 77 and 79 are then raised. The rod 55 is then retracted into the hydraulic cylinder 57 pulling the spud barge 73 up against the stern of the dredge barge 43. The digging spuds 75, 77 and 79 are again lowered and embedded into the bottom of the channel and the anchor spud 69 is raised. The hydraulic dredge barge is then again ready to resume its digging swings.

The efficiency of the apparatus of my invention is clearly shown in FIG. 3 of the drawings. The bank is indicated at 91. It is desired to advance the cutter head to cut a swath 93 having a width of 6 feet and to thereby established a new bank 95. After the swath 93 has been dug by a single swing of the cutter head 45, or multiple swings depending upon the depth of the cut, the hydraulic cylinder 57 is actuated to extend the rod 55 a distance equal to the width of the swath, in this example, a distance of 6 feet. The cutter head is returned in a counterclockwise direction as shown by the arrows digging a swath 97. When the cutter head reaches the end of the swath 97 it is advanced again by actuation of the hydraulic cylinder 57 which extends the rod 55 a distance which is equal to the width of the swath. The cutterhead is then swung clockwise to dig a new swath 99. Using the apparatus of my invention, a number of digging swaths can be made without relocating the spud barge 73. It is not necessary to manipulate any digging spuds until the rod 55 is extended to its full length. The use of swing anchors and the time consuming manipulation of them is eliminated.

I claim:

1. A dredging apparatus including:

a spud barge, digging spuds carried by the spud barge, a dredge barge, a dredging ladder with a cutting head mounted on the forward end of the dredge barge, a pivot sleeve located at the stern of the dredge barge, an arm mounted on the spud barge and having its forward end pivotally connecting to the pivot sleeve of the dredge barge, and means to swing the dredge barge to and fro about the pivotal connection of the spud barge arm and the pivot sleeve including a ring centered on the pivot sleeve and affixed to the dredge barge, a pair of cables and a pair of winches with each cable having one end affixed to the peripheral edge of the ring and extending around the peripheral edge of the ring and an opposite end wound around one of the winches.

2. The dredging apparatus of claim 1 including means to extend and retract the arm relative to the spud barge to move the spud and dredge barges apart and to bring them together.

3. The dredging apparatus of claim 1 in which the arm mounted on the spud barge is pivotally connected to the pivot sleeve for movement relative to the horizontal and to the vertical.

4. The dredging apparatus of claim 1 in which the pivot sleeve is hollow and an anchor spud extends through the pivot sleeve.

* * * * *